US006250992B1

(12) United States Patent
Ikeno et al.

(10) Patent No.: US 6,250,992 B1
(45) Date of Patent: Jun. 26, 2001

(54) MIRROR GRINDING METHOD AND GLASS LENS

(75) Inventors: Junichi Ikeno, Toyohashi; Takayuki Kishida, Yamanashi-ken; Masaru Saeki, Koganei, all of (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/052,710

(22) Filed: Mar. 31, 1998

(30) Foreign Application Priority Data

Apr. 8, 1997 (JP) ..... 9-089363
Feb. 2, 1998 (JP) ..... 10-020098

(51) Int. Cl.[7] ..... B24B 1/00
(52) U.S. Cl. ..... 451/42; 451/277; 451/450
(58) Field of Search ..... 451/450, 159, 451/42, 277

(56) References Cited

U.S. PATENT DOCUMENTS

| | | | | |
|---|---|---|---|---|
| 3,823,515 | * | 7/1974 | Coes, Jr. | 51/322 |
| 3,877,177 | * | 4/1975 | Taniguchi | 51/131 |
| 3,881,661 | * | 5/1975 | Powers et al. | 241/15 |
| 4,907,376 | * | 3/1990 | Bouchard et al. | 51/209 |
| 4,908,995 | * | 3/1990 | Dougherty et al. | 51/281 |
| 4,910,924 | * | 3/1990 | Holden et al. | 51/209 |
| 4,928,435 | * | 5/1990 | Masaki et al. | 51/55 |
| 4,974,368 | * | 12/1990 | Miyamoto et al. | 51/55 |
| 5,085,007 | * | 2/1992 | Tusinski | 51/55 |
| 6,113,464 | * | 9/2000 | Ohmori et al. | 451/41 |

FOREIGN PATENT DOCUMENTS

| | | | |
|---|---|---|---|
| 7-39074 | * | 5/1995 | (JP) . |
| 7-164286 | * | 6/1995 | (JP) . |
| 9-253938 | * | 9/1997 | (JP) . |

OTHER PUBLICATIONS

"Research Concerning Grinding Method Using Electrophoreis Phenomenon of Ultra–Fine Particles" published in 1996 Spring Meeting of The Japan Society for Precision Engineering; pp. 106–107.

"Study of grinding technology which utilizes electrophoresis phenomenon of ultrafine abrasives" Feb. 2, 1993, Society of Grinding Engineers by Shaobu Gai, Yasuhiro Tani and Junichi Ikeno.

* cited by examiner

*Primary Examiner*—Allen Ostranger
*Assistant Examiner*—William Hong
(74) *Attorney, Agent, or Firm*—Frishauf, Holtz, Goodman, Langer & Chick, P.C.

(57) ABSTRACT

A mirror surface grinding method processes an optical glass material into a lens shape using a cup-shaped grinding stone. The grinding stone is pupplied with a polishing solution which contains charged fine particles, thereby electrically attaching the charged fine particles to the grinding stone. The grinding stone is rotated and moved relative to the optical glass material along a final shape to be generated from the optical glass material, thereby grinding an unnecessary portion of the optical glass material to remove it, using a peripheral face portion of the grinding stone, and at the same time polishing the final shape surface of the optical glass material using charged fine particles attached to an annular face portion of the rotating and moving grinding stone.

11 Claims, 10 Drawing Sheets

MIRROR GRINDING METHOD AND GLASS LENS

BACKGROUND OF THE INVENTION

This invention relates to a grinding method using the fine-particle electrophoresis phenomenon, and to a glass lens worked by the grinding method.

A grinding method using the electrophoresis phenomenon is known from, for example, document "Research Concerning Grinding Method Using Electrophoresis Phenomenon of Ultra-fine Particles" published in a 1996 spring convention of The Japan Society for Precision Engineering.

The document describes a grinding device for grinding an object or workpiece 25 so that its surface becomes flat, which comprises, as is shown in FIG. 17, a cup-shaped grinding stone 20 rotatable about its axis of rotation, mounted on an air spindle 30 which is movable along the axis of rotation of the grinding stone, and having a cylindrical portion and a disk-shaped portion; an electrode 21 provided with a predetermined distance from a ring-shaped working end surface of the cylindrical portion of the grinding stone 20; a DC power 22 connected to the electrode 21 and the air spindle 30 such that the electrode and the grinding stone serve as a cathode and an anode, respectively; means 23 for supplying, between the electrode and the stone, a grinding solution with silica fine particles (colloidal silica) 24 dispersed therein; and a sample table 26 opposed to the ring-shaped working end surface and disposed to mount the object 25 thereon.

While in the above grinding device, the grinding solution is supplied between the electrode 21 and the grinding stone 20, negative and positive voltages are applied to the electrode 21 and the grinding stone 20 from the DC power 22, respectively, thereby electrically attaching, to the surface of the grinding stone, silica fine particles which have been charged with negative electricity. Thus, a silica fine-particle layer is formed on the grinding stone surface, as a result of the electrophoresis phenomenon. In this state, the grinding stone 20 is gradually moved along the axis of rotation, and the silica fine-particle layer is brought into contact with the to-be-worked surface of the object. At the same time, the grinding stone 20 is rotated about the rotation axis to thereby make silica fine particles serve as a grinding blade for grinding the object. As a result, the object surface is polished into a mirror surface with little damage.

The above-described grinding method is effective in a case where the to-be-worked surface of the object has beforehand a certain shape (which is not a final surface shape or a surface of a mirror state), and is polished into a mirror surface by slightly removing material therefrom using silica fine particles. For example, the method is effective where only a very thin or small portion of a material has to be ground as in the case of a semiconductor wafer, and it is necessary to minimize the degree of deformation inside the worked material.

However, since in the above-described prior case, the electrical force for holding silica fine particles on the grinding stone is much smaller than the force for grinding the material, the fine particles will fall from the grinding stone if deep cuts are formed in the grinding stone to create a great working force.

In light of this, it is necessary to set the depth of cuts in the grinding stone at an extremely low value of several microns or less, in order to prevent falling of silica fine particles from the stone and to effectively use them as grinding particles.

Therefore, grinders having cuts with a depth of several microns or less are not effective in deeply grinding a workpiece, for example, to generate an optical element such as a lens from a glass blank (an optical glass workpiece). Since the cutting amount of the grinders is extremely small, efficient grinding cannot be performed, and hence an extremely long cutting time is required. This being so, it is necessary in the prior technique to beforehand prepare a material which has its to-be-worked surface ground into as close a shape as possible to the final shape, using another polishing or grinding device. Thus, lots of time is necessary for preparation of such a half product or for generation of a mirror surface from the workpiece or material.

BRIEF SUMMARY OF THE INVENTION

It is the object of the invention to provide a grinding method for simultaneously performing shape generation and mirror surface grinding of an optical glass material, and a glass lens worked by the grinding method.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 3 are views, schematically showing a grinding device for executing a grinding method according to a first embodiment of the invention, in which FIG. 1 shows a state before grinding, FIG. 2 a state in which an optical glass material is made to approach a grinding stone so that it can be ground, and FIG. 3 a state in which the material is being ground;

FIGS. 6 to 8 are views useful in explaining grinding methods according to third and seventh embodiments, in which FIG. 6 shows a state before grinding, FIG. 7 a state assumed while an optical glass workpiece is being ground by the grinding stone, and FIG. 8 the final step of grinding;

FIGS. 11 to 13 are views, useful in explaining a grinding method according to a fifth embodiment of the invention, in which FIG. 11 shows a state before grinding, FIG. 12 a state assumed while an optical glass material is being ground by the grinding stone, and FIG. 13 the final step of grinding;

DETAILED DESCRIPTION OF THE INVENTION

A grinding method according to a first embodiment of the invention will be described with reference to FIGS. 1 to 3 in which the method is applied to a flat lens as an optical element.

Figure 1:
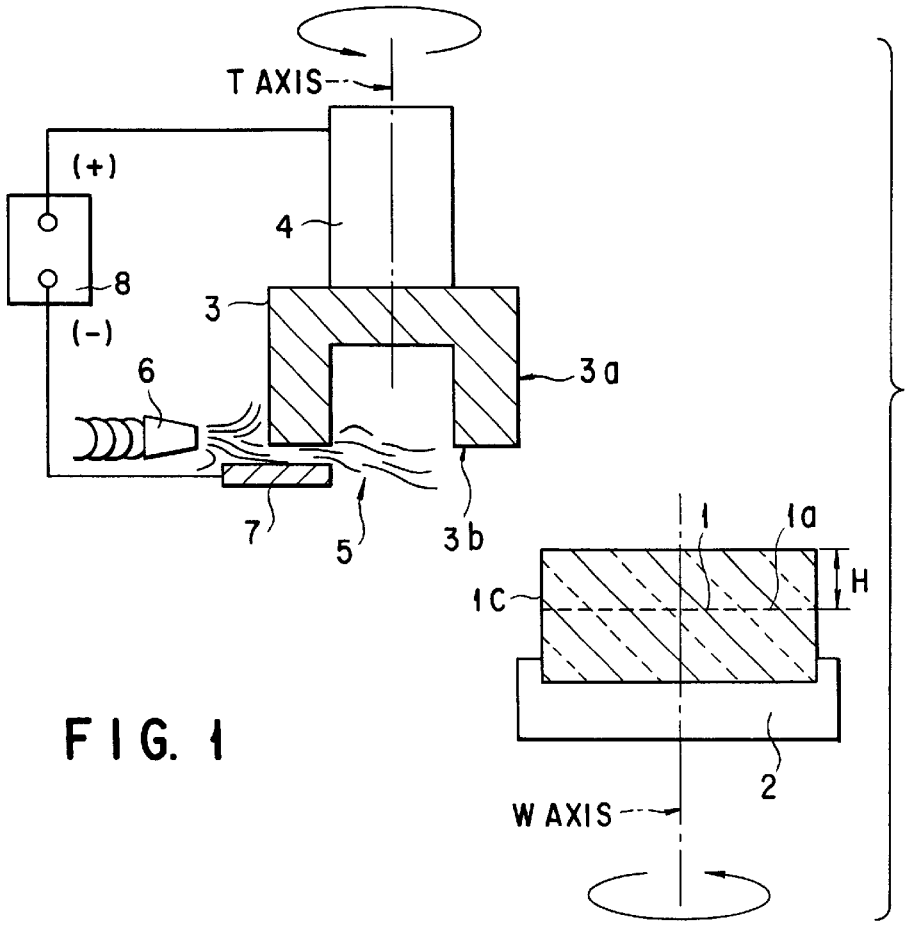

As is shown in FIG. 1, a to-be-worked disk-shaped optical glass material or workpiece 1 is held by a vacuum force on a chuck 2 which is coaxially attached to an end of the rotary shaft of a driving unit (not shown) for rotating the material 1. The optical glass material 1 can be rotated by the chuck 2 about the central axis (W axis) of the rotary shaft of the chuck.

A grinding stone 3 is disposed obliquely above the optical glass material 1 for grinding the material. The grinding stone 3 is supported by known means on one end of a conductive rotary shaft 4 such that the central axis (T axis) of the rotary shaft 4 is parallel to the W axis. The other end of the rotary shaft 4 is connected to the aforementioned grinding stone driving unit. Concerning the optical glass material 1 and the grinding stone 3 located obliquely above it, the T axis is not aligned with the W axis and the diameters of the grinding stone 3 and the workpiece 1 are set so that a side face portion 3*a* of the stone 3 and a side face portion 1*c* of the material 1 will not interfere with each other, before the stone works the material, even when the grinding stone 3 is lowered along the T axis.

The grinding stone driving unit connects the grinding stone 3 to a two-directionally and linearly advancing unit (not shown) such that the grinding stone 3 can move along the T-axis direction and a direction perpendicular thereto.

The grinding stone 3 comprises a disk-shaped portion and a cylindrical portion formed integral with the disk-shaped portion and concentrically projecting therefrom. In other words, the grinding stone 3 is cup-shaped. The stone 3 is formed by fixing grinding particles such as diamond with a conductive bonding material (e.g. bronze, nickel or cast iron), and electrically connected to the rotary shaft 4.

The side face portion 3*a* of the grinding stone 3 functions as a shape-generating face, which cuts and removes an unnecessary portion of the optical glass material 1 from its side face portion 1*c* when the grinding stone 3 rotates and moves to the optical glass material 1 in the direction perpendicular to the T axis, thereby grinding the material 1 into a desired shape (final shape).

The front or lower end face 3*b* of the cylindrical portion of the grinding stone 3 is a ring-shaped flat face, which is perpendicular to the T axis and has its center aligned with the T axis. The front face portion 3*b* functions as a polishing face for polishing the surface of the material shaped by the side face portion (shape-forming face) 3*a*. The polishing by the front face portion 3*b* is performed simultaneous with the shaping by the side face portion 3*a*, using silica fine particles (which will be described later).

A nozzle 6 is located below the grinding stone 3 in a position opposite to the optical glass material 1 with respect to the T axis, in order to apply, to the optical glass material 1 and the grinding stone 3, a polishing solution 5 which contains silica fine particles pre-charged with negative electricity (colloidal silica with an average particle diameter of $\phi$10 nm). An electrode 7 is provided in the vicinity of the discharge port of the nozzle 6 such that it is opposed to part of the front face portion 3*b* of the grinding stone 3 with a predetermined space therebetween. The electrode 7 is connected to the cathode of a DC power 8, and the anode of the power 8 is connected to the rotary shaft 4.

The grinding method using the above-described grinding device will be described with reference to FIGS. 1 to 3.

First, the optical glass material 1 is held on the chuck 2, and the workpiece 1 with the chuck 2 and the grinding stone 3 are arranged as shown in FIG. 1. Then, the material 1 and the grinding stone 3 are rotated about the W axis and the T axis by the object driving unit and the grinding stone driving unit, respectively. At the same time, the polishing solution 5 is discharged from the nozzle 6 onto the grinding stone 3, the optical glass material 1 and the electrode 7, and the DC power 8 applies a negative voltage to the electrode 7 and a positive voltage to the grinding stone 3 via the rotary shaft 4.

Figure 2:
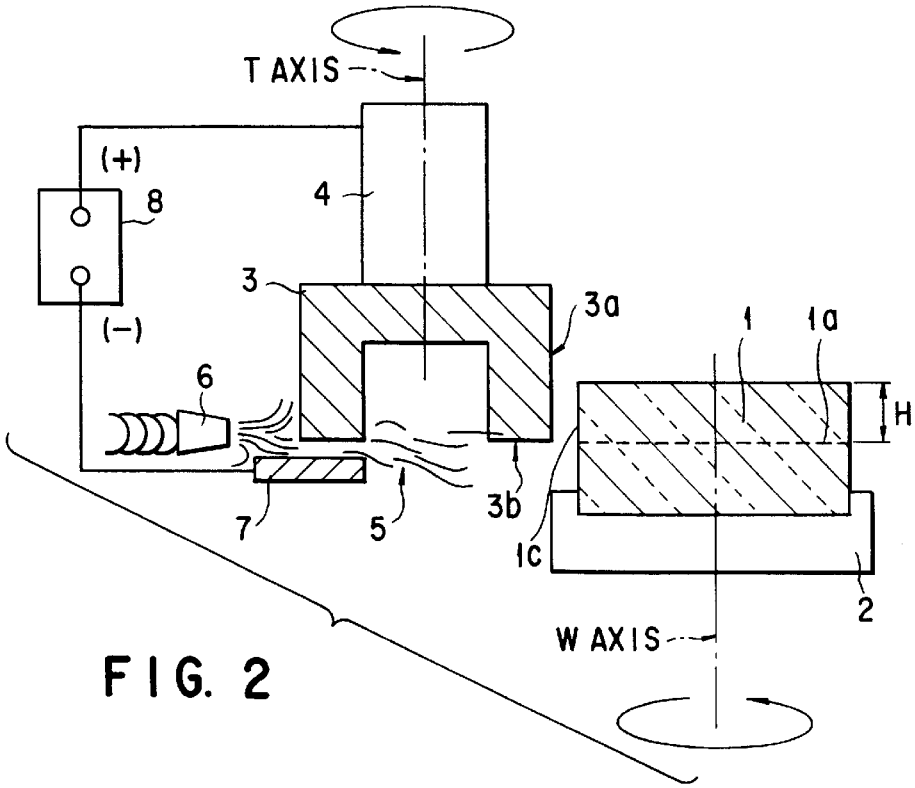
Figure 3:
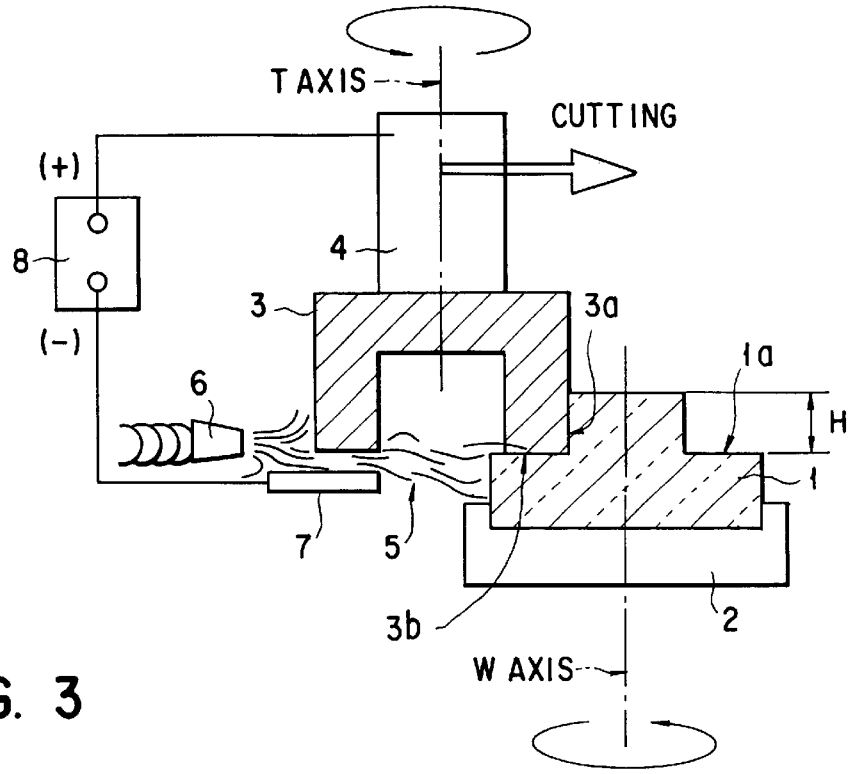

Subsequently, as shown in FIG. 2, the grinding stone 3 is lowered along the T axis and situated in a position near a side portion of the optical glass material 1. In this position, the front face portion 3*b* of the grinding stone 3 vertically reaches a final shape surface 1*a* of the material 1 (i.e. the surface obtained when the material 1 is cut by an amount of H), and the lower end (outer peripheral edge) of the front face portion 3*b* does not contact the material 1 (i.e. the lower end does not interfere with the upper surface and the side face portion 1*c* of the material 1). The electrode 7 and the nozzle 6 are lowered together with the grinding stone 3. To enable the movement of the electrode 7 and the nozzle 6 with the grinding stone 3, they may be mechanically connected to each other by means of a common member, or their movement may be synchronized by a driving mechanism different from that of the grinding stone 3.

Silica fine particles jetted from the nozzle 6 and charged with negative electricity are electrically attracted by and attached to the grinding stone 3 to which positive voltage is applied, as a result of the so-called electrophoresis phenomenon. The grinding stone 3 of this state is shifted toward the W axis, i.e. to the right in FIG. 2. Then, as shown in FIG. 3, the side face portion 3*a* is brought into contact with the side face portion 1*c* of the material 1, and starts to cut it by the cutting amount of H, thereby shaping the material 1 using the side face portion 3*a* as a generating work surface. At the same time, the front face portion 3*b* is passed along the final shape surface 1*a* generated by the side face portion 3*a* (which means the so-called creep feed grinding). Since the grinding for shaping the optical glass material 1 is performed by the side face portion 3*a*, a very stronger grinding force (working force), i.e. a stronger force for removing the unnecessary portion (the portion to be removed by the cutting amount of H) of the material 1, occurs during grinding at the side face portion 3*a* than at the front face portion 3*b*. Accordingly, the silica fine particles are not liable to electrically attach to the side face portion 3*a*. However, since the grinding stone 3 is of a multi-blade structure which includes lots of grinding particles, and there are always projecting grinding particles on the grinding stone 3, the optical glass material 1 can sufficiently be shaped by only the projecting particles. This means that even if many of silica fine particles fall from the side face portion 3*a*, it will not greatly influence the material shaping. On the other hand, silica fine particles are more liable to attach to the front face portion 3*b* during the working than to the side face portion 3*a*. This is because on the front face portion 3*b*, the difference in height between the grinding particles and the bonding material is sufficient as a clearance which is required for holding the fine particles (such a clearance as enables electrical attraction of the fine particles enough to make it difficult for them to fall), and also because the front face portion 3*b* does not cut the material, i.e. the cutting amount is zero, and hence it requires only a small working force.

Where lots of silica fine particles attach to the front face portion 3*b*, the clearance between the grinding particles and the bonding material is filled with them, and therefore the total projection of the grinding particles on the front face portion 3*b* appears low. Accordingly, when the front face portion 3*b* passes along the final shape surface 1*a*, it polishes the surface 1*a* into a mirror surface, using both the grinding particles whose total projection appears low, and the silica fine particles attaching to the front face portion 3*b*.

In other words, the front face portion 3*b* functions as a polishing face, and the silica fine particles attaching thereto are used to perform mirror-surface grinding of a form-shaped material. Although during grinding, lots of silica fine particles electrically attaching to the front face portion 3*b* sequentially fall because of the grinding force, negative-voltage-charged silica fine particles are sequentially created from the polishing solution 5 which is always supplied by the nozzle 6, and attach to the front face portion 3*b* of the grinding stone 3. As a result, there is no degradation of polishing performance due to fall of silica fine particles. Further, since the silica fine particles attaching to the grinding stone 3 absorb shock which occurs during grinding, the rotation of the grinding stone 3 is stabilized, which prevents that run-out of the grinding stone 3 or that excessive cutting of the optical glass material 1 by the grinding particles, which may well cause a defect such as a crack in the material 1.

After the grinding stone 3 further moves and the side face portion 3*a* reaches the W axis, the grinding stone 3 is moved upward along the T axis to separate from the optical glass material 1. Then, the supply of the polishing solution 5, the voltage application by the power 8, and the rotation of the grinding stone 3 and the material 1 are stopped, and the resultant flat lens is taken from the chuck 2. A flat lens with its both opposite sides polished can be obtained by placing the one-side polished flat lens on the chuck 2 with its reverse surface directed upward, and repeating a working process as above.

Although in the above embodiment, the grinding stone 3 is moved to the optical glass material 1 to grind it, the same working can be performed by shifting the optical glass material 1 in a direction perpendicular to the W axis with the grinding stone 3 kept rotate in a fixed position, or by causing both the grinding stone 3 and the material 1 to approach each other.

In the above embodiment, shaping and polishing (mirror surface grinding) of a material can be performed simultaneously using a general grinding stone. Accordingly, the time required for the shaping and polishing can be significantly shortened as compared with the conventional case.

Further, since silica fine particles contained in the polishing material 5 absorb shock which occurs during grinding, the rotation of the grinding stone 3 is stabilized. Therefore, run-out of the grinding stone 3 is prevented, thereby avoiding the excessive cutting of the optical glass material 1 by the grinding particles which may well cause a defect such as a crack in the material 1.

Although in the embodiment, colloidal silica is used as a fine particle substance contained in the polishing material 5, the same effect can be obtained if colloidal cerium is used. Moreover, it may easy to understand that other fine particles known in this technical field may be used.

Moreover, although in the embodiment, both the grinding stone 3 and the optical glass material 1 are rotated, it may be modified such that one of them is rotated in light of whether or not the material 1 is easy to grind, the desired surface configuration of the material 1, or whether or not a to-be-cut portion of the material 1 is large. In this case, it is necessary to control the grinding stone 3 so that the front face portion 3*b* will pass the overall area of the final shape surface 1*a* (the to-be-polished surface of the optical glass material 1).

Furthermore, although in the embodiment, a flat lens is ground, an optical element of any other shape, such as a prism, may be ground.

Figure 4:
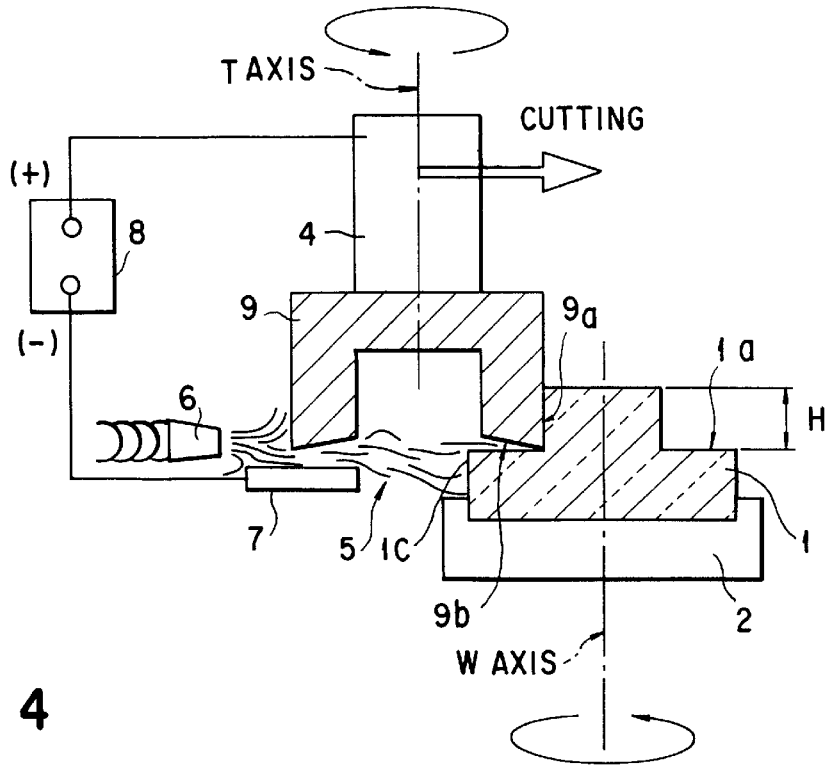
FIG. 4 is a schematic view similar to FIG. 3, showing a grinding device for executing a grinding method according to a second embodiment of the invention.

Referring then to FIG. 4, a grinding method according to a second embodiment will be described.

FIG. 4 shows a state where the side face portion 9*a* of a cup-shaped grinding stone 9 cuts the optical glass material 1 from its periphery 1*c* by a cutting amount of H in a direction perpendicular to the T axis. Both the grinding stone 9 and the optical glass material 1 are rotated.

The front face portion 9*b* of the grinding stone 9 is inclined such that when its outer peripheral edge contacts a to-be-polished flat surface of the optical glass material 1, it slants gradually away from the material 1 in a direction toward the T axis. In other words, the front face portion 9*b* is inclined such that its edge becomes higher toward the T axis with respect to the plane perpendicular to the T axis; that is, the front face portion 9*b* is tapered from the outer peripheral edge to the inner peripheral edge. The other structural elements of the second embodiment are similar to those of the first embodiment, and hence no detailed description is given thereof. Further, the second embodiment performs grinding in the same procedure as in the first embodiment.

Since in the second embodiment, the front face portion 9*b* of the grinding stone 9 is tapered, part of the front face portion is completely out of contact with the final shape surface (to-be-polished surface) 1*a* of the optical glass material 1 during grinding (in the FIG. 4 state). On the non-contact portion, grinding particles projecting from the bonding material are out of contact with the optical glass material 1, and therefore only silica fine particles attaching to part of the front face portion 9*b* (or silica particles attaching to the front face portion 9*b* and forming a lamination) are brought into contact with the optical glass material 1. Accordingly, the amount of polishing by silica fine particles increases, which means that higher quality mirror surface grinding is performed in the second embodiment than in the first embodiment.

Figure 5:
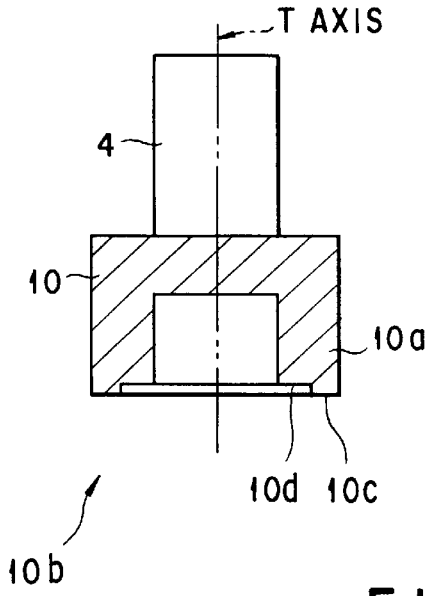
FIG. 5 is a sectional view, showing a modification of the grinding stone employed in the second embodiment.

The front face portion 9*b* of the grinding stone 9 can have a shape other than the above-described one. For example, as is shown in FIG. 5, the front face portion 9*a* may have a plurality (two in FIG. 5) of annular surfaces which extend perpendicular to the T axis and shifts along the T axis. In the FIG. 5 case, a cup-shaped grinding stone 10 has a front face portion 10*b* stepped along the T axis and consisting of an outer annular flat face 10*c* and an inner annular flat face 10*d*. The difference in height between the flat faces 10*c* and 10*d* is set at a value not higher than the height of silica fine particles to be adhered to the grinding stone 10.

In the grinding stone 10, at the outer flat face 10*c*, grinding particles projecting from the bonding material are put into contact with the optical glass material 1, which means that the outer flat face 10*c* has a function similar to the front face portion 3*b* (in FIG. 1) of the grinding stone 3 employed in the first embodiment. On the other hand, at the inner flat face 10*d*, grinding particles projecting from the bonding material are out of contact with the optical glass material 1, which means that the inner flat face 10*d* has a function similar to the non-contact portion employed in the second embodiment. Since in the grinding stone 10, stress concentration at the outer edge of the front face portion 10*b*, i.e. between the outer flat face 10*c* and the side face portion 10*a*, is reduced to thereby suppress the occurrence of chipping off of the grinding stone and enable stable grinding.

Figure 6:
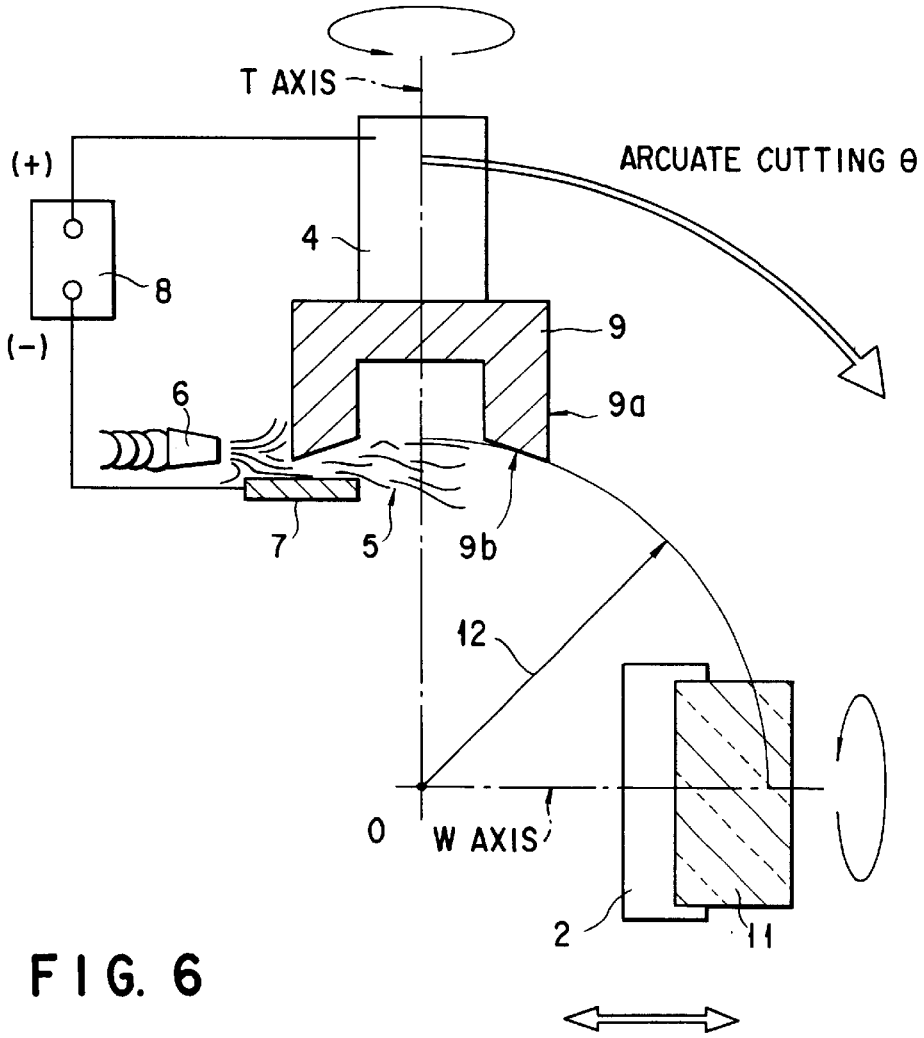
Figure 9A:
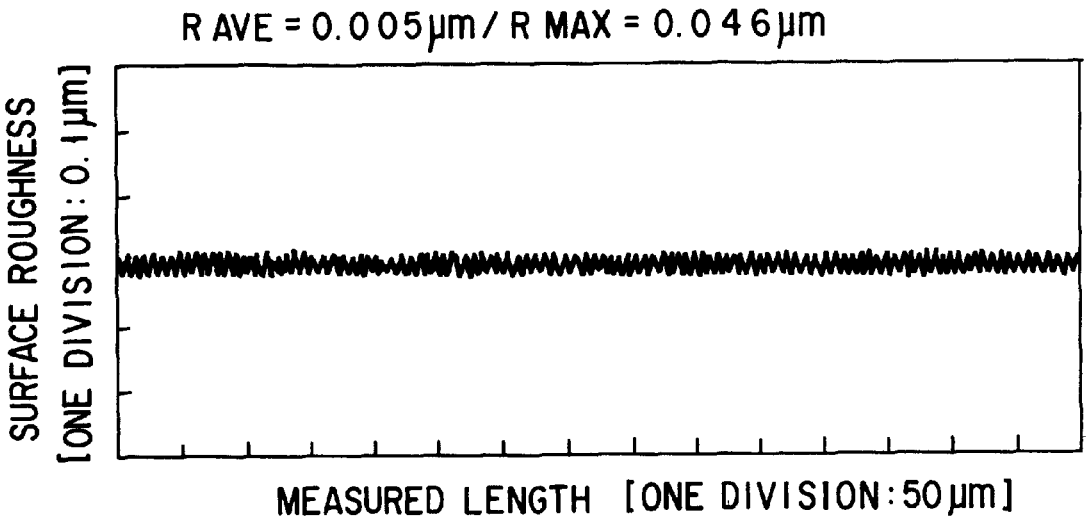
FIGS. 9A and 9B are graphs, showing measurement results obtained by measuring the surface roughnesses of objects ground with the grinding method of the third embodiment and a usual grinding method.
Figure 9B:
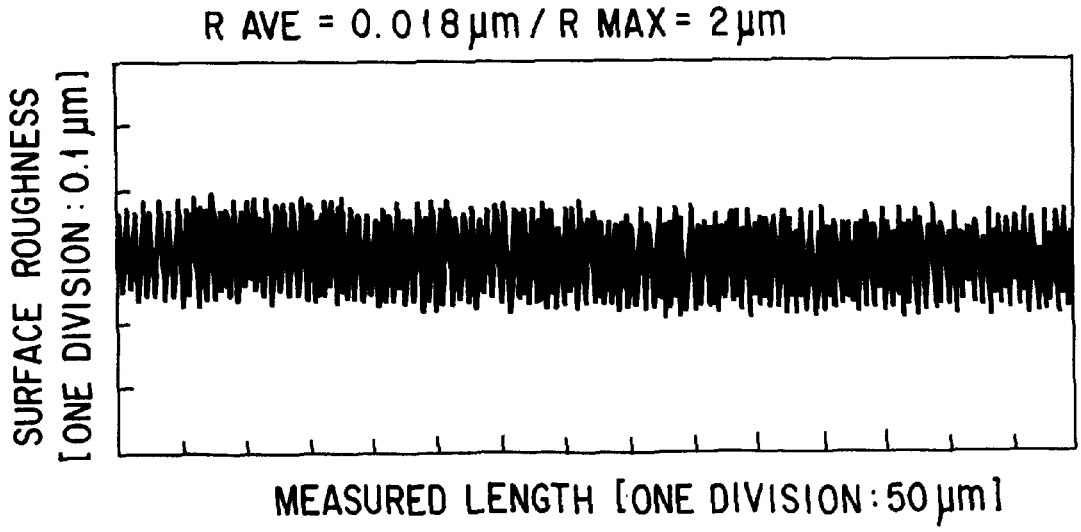
FIG. 9B (PRIOR ART)

Referring then to FIGS. 6, 9A and 9B, application of a grinding method according to a third embodiment to grinding of a spherical lens will be described.

As is shown in FIG. 6, the rotary shaft (W axis) W of the chuck 2 is substantially perpendicular to the rotary shaft (T axis) T of the rotary shaft 4 which supports the grinding stone 9. The axis of an optical glass material 11 to be ground is identical to the W axis, and the optical glass material 11 is held by the chuck 2 such that it can rotate about the W axis. The chuck 2 is attached to the rotary shaft of a driving unit (not shown) for rotating a to-be-ground object, and the driving unit is incorporated in an object shifting unit (not shown) such that it can move along the W axis.

A cup-shaped grinding stone 9 is provided on a lateral side of the optical glass material 11. Since the grinding stone 9 has the same structure as that employed in the second embodiment, no description is given thereof. The grinding stone 9 is held by the conductive rotary shaft 4 such that it can rotate about the T axis as an axis of rotation, which coincides with the axis of the front face portion 9*b* and on which axis the center-of-curvature O of a sphere into part of which the optical glass material 11 is cut exists.

The rotary shaft 4 is attached to a grinding stone driving unit (not shown), and the grinding stone driving unit is incorporated in a grinding stone shifting unit (not shown) such that the grinding stone 9 can move along the T axis. The grinding stone shifting unit is incorporated in a driving mechanism (not shown) such that it can revolve or swing about the center-of-curvature O. This driving mechanism has a nozzle 6 and an electrode 7, which are similar to those in the first and second embodiments and can follow the rotation of the grinding stone 9 (angular movement from a state shown in FIG. 6 in which the stone is substantially perpendicular to the optical glass material 11, to a state in which the angle therebetween is reduced), with a relative relationship to the grinding stone 9 kept. A specific state in which the nozzle and the electrode 7 are attached is not shown. The other elements have the same structures as in the first and second embodiments, and therefore no description is given thereof.

Figure 7:
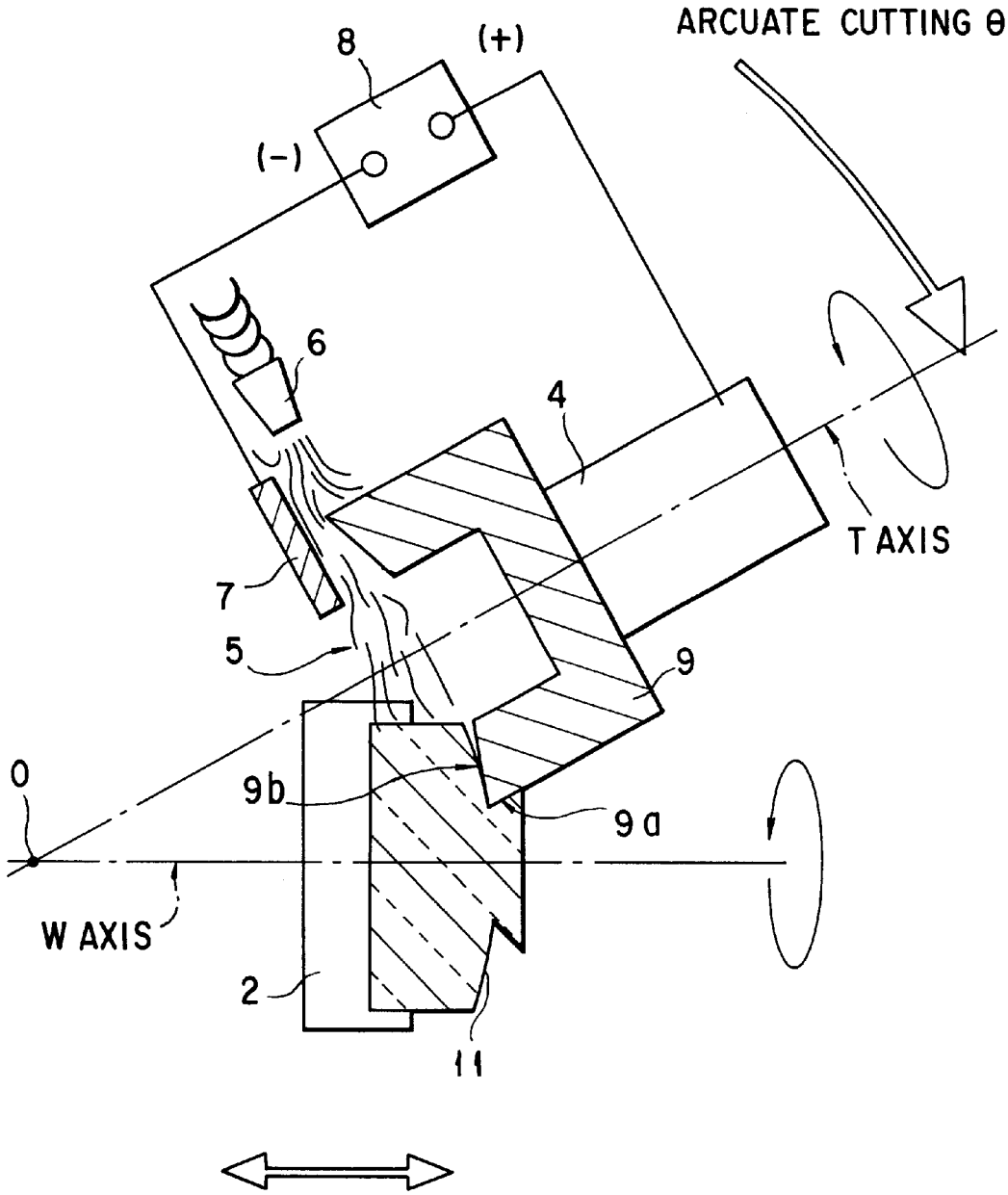
Figure 8:
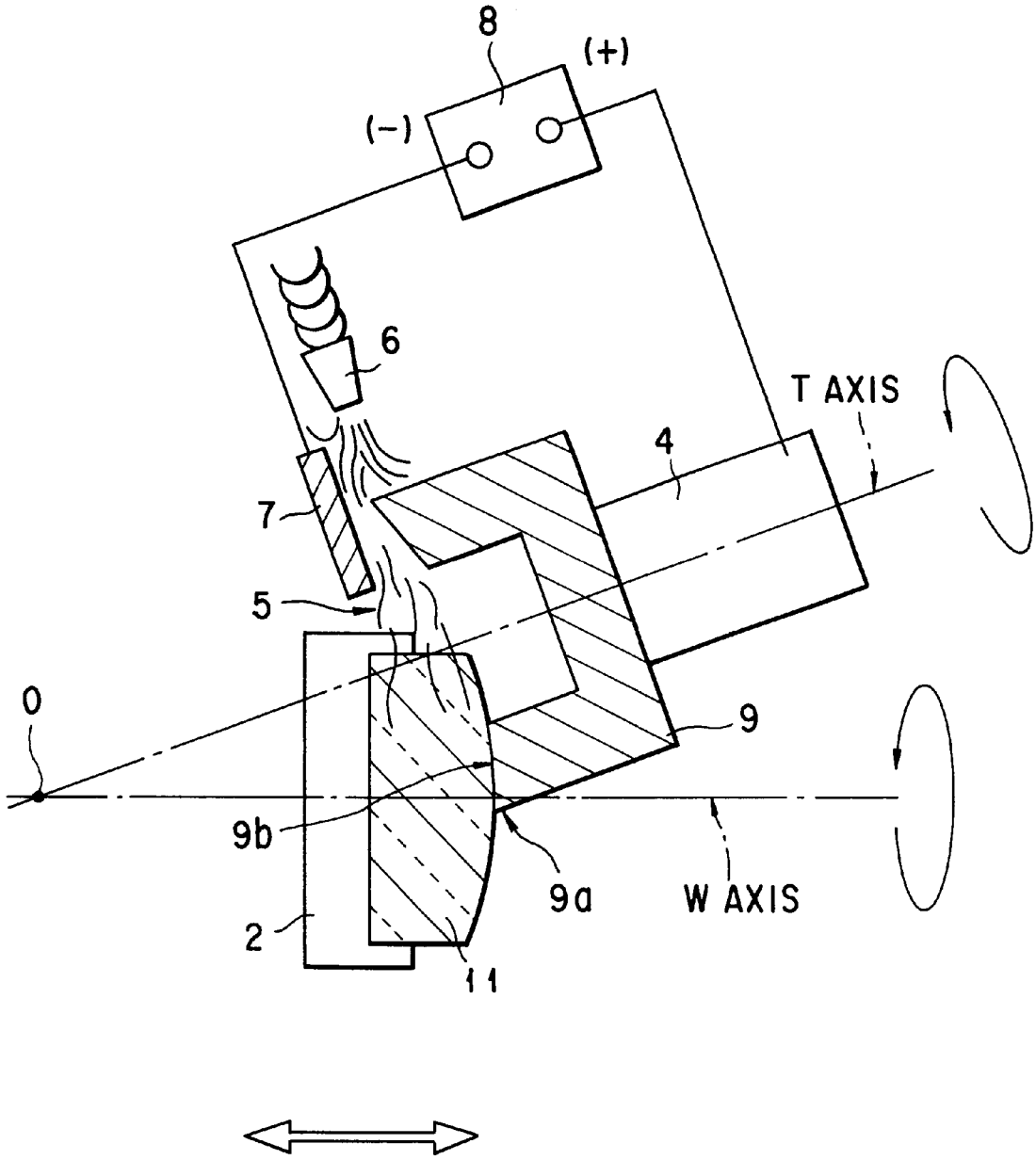

Referring to FIGS. 6–8, a grinding method employed in the above-described grinding device will be described.

First, the T-axial position of the grinding stone 9 is set so that a to-be-generated spherical shape of a workpiece 11 will coincide with the locus of the front face portion 9*b* of the grinding stone 9 which is obtained when the grinding stone 9 is rotated. Specifically, as shown in FIG. 6, the grinding stone 9 is moved along the T axis by the stone shifting unit and positioned so that when the grinding stone 9 is revolved by the driving unit, the locus of the front face portion 9*b* in the optical glass material 11 will follow a circular arc which has the same curvature as a to-be-generated spherical shape. In other words, the grinding stone 9 is positioned so that the distance between the center-of-rotation O and the portion of the optical glass material 11 along which the front face portion 9*b* passes will coincide with the radius-of-curvature 12 of the to-be-generated spherical shape.

Subsequently, the optical glass material 11 is set on the chuck 2 of the object driving unit, and the W-axial position of the material 11 is determined using the object shifting unit so that the locus of the front face portion 9*b* in the optical glass material 11 will follow a circular arc having the same curvature as the to-be-generated spherical shape, thereby determining the amount of cutting which starts from the periphery of the material 11.

After positioning of the grinding stone 9 and the optical glass material 11, the material 11 is rotated about the W axis by the object driving unit, and the grinding stone 9 is rotated about the T axis by the stone driving unit. At the same time, a polishing solution 5 which contains silica particles (colloidal silica) with negative charge is applied between the grinding stone 9 and the electrode 7 from the nozzle 6, and a negative voltage is applied from the DC power 8 to the electrode 7, and a positive voltage from the DC power 8 to the grinding stone 9 via the rotary shaft 4. The silica particles with negative charge are electrically attracted, as a result of the so-called electrophoresis, by the grinding stone 9 with the positive voltage, and electrically attached thereto.

Thereafter, the edge of the side face portion 9*a* (i.e. the outer edge of the front face portion 9*b*) of the grinding stone 9 is revolved by the driving unit about the center O of the to-be-generated spherical shape, so that a spherical shape with a radius-of-curvature 12 can be drawn, thereby starting arcuate cutting θ of the optical glass material 11 from its periphery, using the side face portion 9*a* as a shape-generating surface, as is shown in FIG. 7.

While the arcuate cutting θ is continued, a final spherical shape is generated by the edge of the side face portion 9*a*, and at the same time, the front face portion 9*b* is passed along the final spherical shape generated by the edge of the side face portion 9*a* (so-called creep feed grinding is performed). Since in this grinding, the side face portion 9*a* receives a very strong grinding force for generating a shape (removing an unnecessary portion of the optical glass material), most of silica fine particles attached thereto will fall and be hard to reattach. However, the grinding stone 9 is of a multi-blade structure which includes lots of grinding particles, and hence there always exist grinding particles projecting from the grinding stone 9. These grinding particles can sufficiently shape the side face portion 9*a*. Thus, even when most of silica fine particles fall from the side face portion 9*a*, shape generation can be performed without any trouble.

On the other hand, during grinding, silica fine particles attach more easily to the front face portion 9*b* than to the side face portion 9*a*. This is because on the front face portion 9*b*, the difference in height between the grinding particles and the bond material is sufficient to define a space for holding silica fine particles (sufficient to keep them electrically) therein, and because the front face portion 9*b* does not perform cutting and therefore use a large grinding force.

When lots of silica fine particles attach to the front face portion 9*b*, they are filled between the grinding particles and bond material, and therefore the total projection of grinding particles on the front face portion 9*b* appears low. Accordingly, when the front face portion 9*b* passes along the material of the final spherical shape, it polishes the material into a mirror surface, using both the grinding particles whose total projection appears low, and the silica fine particles attaching to the front face portion 9*b*.

Although during grinding, lots of silica fine particles electrically attaching to the front face portion 9*b* sequentially fall because of the grinding force, they are sequentially created from the polishing solution 5 which is always supplied by the nozzle 6, and attach to the front face portion 9*b*. As a result, there is no degradation of polishing performance due to fall of silica fine particles. Further, since the silica fine particles attaching to the grinding stone 9 absorb shock which occurs during grinding, the rotation of the grinding stone 9 is stabilized, which prevents that run-out of the grinding stone 9 or that excessive cutting of the optical glass material 11 by the grinding particles, which may well cause a defect such as a crack in the material 11.

When the arcuate cutting θ is continued, and the edge of the front face portion 9*b* which contacts the optical glass material 11 has reached the W axis as shown in FIG. 8, the cutting is stopped.

After the termination of the arcuate cutting θ, the grinding stone 9 is moved upward along the T axis to be separated from the optical glass material 11, and is revolved by the driving unit to the initial position, i.e. the position shown in FIG. 6. At the same time, the supply of the polishing material 5 through the nozzle 6, the voltage application by the DC power 8, and the rotation of the grinding stone 9 and the optical glass material 11 are stopped, and a flat convex lens as a resultant product is taken from the chuck 2.

In the above embodiment, arcuate cutting θ of the optical glass material is performed by revolving the grinding stone 9 about the center-of-curvature θ, to form a spherical shape. However, it can also be done by revolving the optical glass material 11 in a direction opposite to the θ-directional rotation of the grinding stone 9, after positioning the grinding stone 9 and the material 11 along the T axis and the W axis, respectively, and fixing the grinding stone 9 in position.

A convex lens with its both opposite sides shaped as convex surfaces can be obtained by placing the one-side worked lens on the chuck 2 with its reverse surface directed upward, and repeating a process as above.

As described above, spherical shape generation and mirror surface grinding can be simultaneously performed simply by rotating the grinding stone 9 about the center-of-curvature O of a to-be-generated spherical shape, i.e. by simple angular movement i.e. one-axis movement of the stone 9. The other advantages of the second embodiment are similar to those of the first embodiment.

In the third embodiment, the front face portion 9*b* has a tapered surface, i.e. has a surface shape differing from a to-be-generated spherical shape. If, however, the front face portion 9*b* is made beforehand to have the radius-of-curvature 12 of the to-be-generated spherical shape, it can shape the optical glass material 11 at a higher surface accuracy or shape accuracy. Further, a grinding stone may be used which has a flat front face portion as employed in the first embodiment, or has a front face portion with an axial semi-circular section (which means that the edge of the cup-shaped grinding stone has a semi-circular section). In addition, although the grinding stone 9 is situated in a position in which the T axis intersects the W axis in FIG. 6 (showing a state before grinding), it is not always necessary to make the T and W axes intersect each other. It suffices if the side face portion 9*a* of the grinding stone 9 is out of contact with the optical glass material 11.

A case where the grinding method according to the third embodiment is applied to actual grinding will be described.

In this case, FPL53 was used as the optical glass material 11, and SD800N100MF41 produced by Shin-Nissan Diamond Corporation, in which # 800 diamond grinding particles are fixed by a metallic bond, was used as the grinding stone 9. A solution which contains a 6 wt % colloidal silica polishing material with a particle diameter of 30–80 Å was used as the polishing solution 5. The distance between the grinding stone 9 and the electrode 7 was set at 1–2 mm, and a voltage of 40V was applied between the electrode 7 and the grinding stone 9.

Under the above-described conditions and in the state shown in FIG. 6, the grinding stone 9 and the optical glass material 11 were rotated at 7000 rpm, the polishing solution 5 was applied between the grinding stone 9 and the electrode 7, and a voltage of 40V was applied between the electrode 7 and the grinding stone 9. This state was kept for 20 minutes, thereby electrically attaching silica fine particles to the grinding stone 9. Thereafter, as shown in FIG. 7, the supply of the polishing solution 5 and the application of the voltage were continued, while the grinding stone 9 was advanced into the optical glass material 11 at a circumferential speed of 6 mm/min. (where the W-axial depth of the material 11 by which it should be cut is set at 0.1 mm). The remaining portion of the procedure is the same as the third embodiment.

The comparison was performed of a surface resulting from the above-described grinding method, and a surface (a comparative) resulting from another case using a grinding method similar to the above except that no voltage was applied between the electrode 7 and the grinding stone 9 (hereinafter referred to as "usual grinding method"). Actually, pictures of the resultant surfaces, which were obtained by the Nomarski microscope set at a power of 100, were compared. As a result, abrasions due to diamond grinding particles contained in the grinding stone were observed in the comparative, whereas no such abrasions were found in the surface obtained by the grinding method of the invention. This means that the abrasions were removed during polishing by silica fine particles. Further, it was recognized from the picture of the surface obtained by the invention that striped traces from polishing were locally formed in place of the abrasions.

Then, the roughness of the surface resulting from the third embodiment and that resulting from the usual grinding method were measured for comparison.

FIG. 9A shows the measurement results of the surface obtained by the third embodiment, and FIG. 9B the measurement results of the surface obtained by the usual grinding method.

In each of FIGS. 9A and 9B, the abscissa indicates the measured length (one division: 50 μm), and the ordinate the surface roughness (one division: 0.1 μm). In the case of the usual grinding method, the average roughness Rave and the maximum roughness Rmax were 0.018 μm and 2 μm, respectively, as shown in FIG. 9B. On the other hand, in the case of the third embodiment, Rave and Rmax were 0.005 μm and 0.046 μm, respectively, as shown in FIG. 9A.

It was confirmed also from the surface roughness measurement results that the grinding method of the embodiment can provide a surface closer to a mirror surface than the usual grinding method. Moreover, when the overall area of the glass lens surface processed in the embodiment was observed using the Nomarski microscope or an interatomic force microscope, there were traces resulting from polishing by silica fine particles.

When the surface processed in the embodiment was observed using the Nomarski microscope set at a power of about 1000, extremely fine polishing traces, which seemed to indicate relative movements of the grinding stone 9 and the optical glass material 11, were found. Further, when the surface was observed using the interatomic force microscope, it was detected that the depth of the polishing traces ranged from 1 nm to 10 nm. In particular, a polishing trace was especially clearly observed, which was similar to a locus and obtained when the process was completed, i.e. when the arcuate cutting θ by the grinding stone 9 was completed and the front face portion 9*b* coincides with the W axis.

Figure 16:
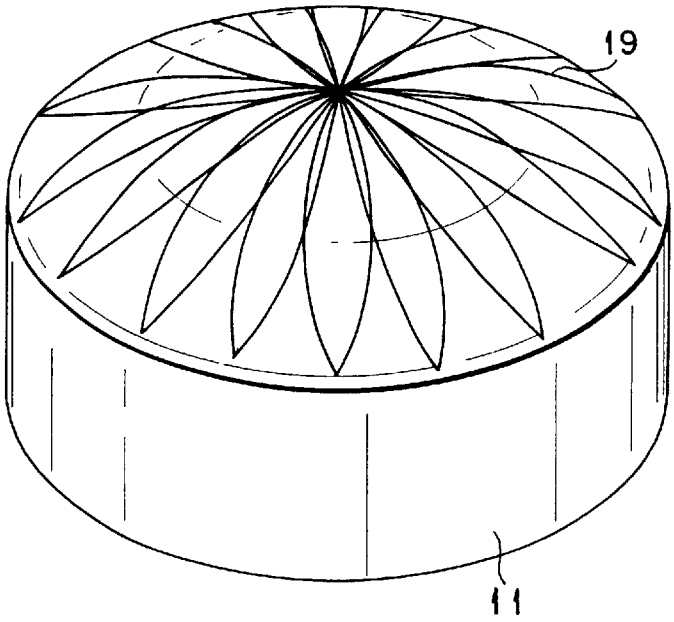
FIG. 16 is a view, showing a fine polishing trace pattern of the surface of a lens worked by the grinding method of the third embodiment.
Figure 17:
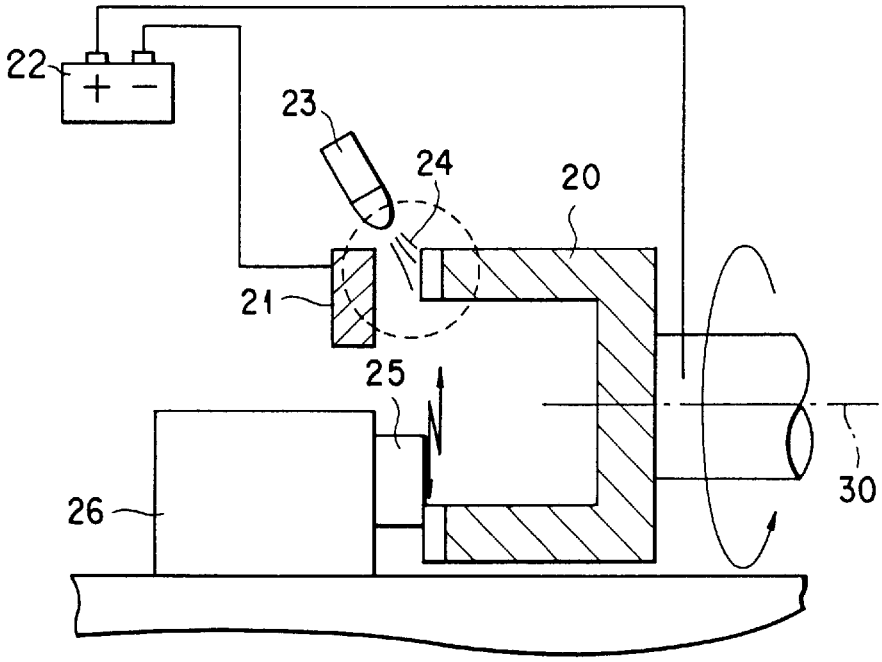
FIG. 17 (PRIOR ART)
FIG. 17 is a view, useful in explaining a conventional grinding method using the electrophoresis phenomenon.

The thus-observed polishing trace is shown in FIG. 16. In the case of the embodiment, a polishing trace 19 like lots of "flower petals" was observed as shown in FIG. 16. Since the polishing trace 19 is a group of striped traces caused by polishing by silica fine particles, it is very fine and characterized, in particular, in that it is formed by silica fine particles electrically attached to the grinding stone 9, and hence has a regular geometrical pattern, which differs from an irregular polishing pattern observed in the conventional polishing using isolated grinding particles. In other words, the polishing trace indicates a locus formed as a result of movements of the grinding stone 9 and the optical glass material 11.

Although in the embodiment, the polishing trace 19 shown in FIG. 16 was observed, it cannot always be found since the resultant trace depends upon the manner of movement. It is a matter of course that the trace changes when a different cutting method is employed. In addition to this, the polishing trace 19 will change only if the speed of angular cutting or the rotational speed of the optical glass material is changed. However, so long as the polishing trace is based on polishing performed by fine particles attached to the grinding stone due to the electrophoresis phenomenon, it always shows a regular though varying pattern.

Depending upon the quality level of a glass lens, for example, in the case of a lens for use in a semiconductor exposure device, it may be necessary to further polish the regular polishing trace into an irregular one by finishing polishing such as known pitch polishing which uses an isolated grinding stone. Since, however, the fine polishing trace 19 formed by silica fine particles has a depth of 10 nm or less, the glass lens formed by the invention can show sufficient optical properties for various purposes, and hence does not require the step of troublesome finishing polishing as employed in the conventional case. Accordingly, a glass lens can be produced in a short time at low cost.

A fourth embodiment of the invention will be described with reference to FIG. 10.

The fourth embodiment is characterized in that cutting of the optical glass material 11 into a spherical shape with a radius-of-curvature 12 is performed in two stages. Since the basic structure of a grinding device used in this embodiment is similar to that in the third embodiment, no detail explanation will be given thereof.

Figure 10:
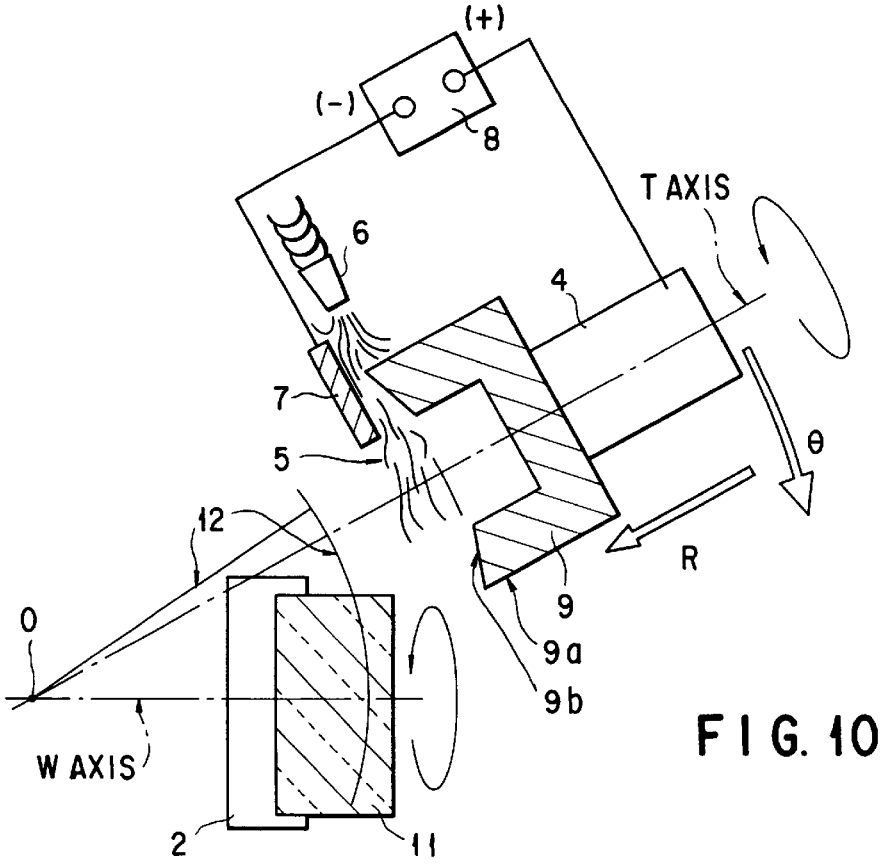
FIG. 10 is a schematic view, useful in explaining a grinding method according to a fourth embodiment of the invention.

First, as shown in FIG. 10, the W-axial positioning of the optical glass material 11 is performed in the same manner as in the third embodiment, and then the T axis of the grinding stone 9 is inclined with respect to the W axis, thereby causing the grinding stone 9 to standby at the front face portion side of the optical glass material 11.

The inclination of the T axis is set to a value at which the front face portion 9*b* can interfere with the optical glass material 11 when it is moved to the material.

Then, the optical glass material 11 is rotated about the W axis by a to-be-processed object driving unit (not shown), and the grinding stone 9 is rotated about the T axis by a grinding stone driving unit (not shown). At the same time, the polishing solution 5 which contains silica fine particles (colloidal silica; the average particle diameter: ϕ10 nm) with negative charge is supplied between the grinding stone 9 and the electrode 7, while a negative voltage is applied from the DC power 8 to the electrode 7, and a positive voltage from the same power to the grinding stone 9 via the rotary shaft 4. The silica fine particles with negative charge are electrically attracted, as a result of the so-called electrophoresis, by the grinding stone 9 with the positive voltage, and electrically attached thereto.

Subsequently, the grinding stone 9 is advanced along the T axis, thereby starting linear cutting R of a corner portion of the optical glass material 11. The first-stage cutting is performed by the front face portion 9*b*. Since at this time, the front face portion 9*b* functions as a shape generating face unlike the third embodiment, a large force acts thereon, and hence most of silica fine particles attached thereto will fall. However, it suffices, in the first cutting stage, if grinding particles projecting from the front face portion 9*b* cut the optical glass material 11 in accordance with the conventional cutting method. Therefore, no problems will arise. The linear cutting R is continued, and finished when the front face portion 9*b* has reached a line which is defined by the radius-of-curvature 12 of a to-be-generated spherical surface.

Thereafter, as in the third embodiment, arcuate cutting θ of the optical glass material 11 is performed by revolving the grinding stone 9 using its driving unit, to form the spherical surface. In other words, the second-stage cutting is performed by the side face portion 9*a*. In this stage, shaping of the spherical surface and polishing of the surface of the shape are simultaneously performed as in the third embodiment. Since thus, the portion cut in the first stage is polished by silica fine particles attached to the front face portion 9*b* in the second stage, a similar process to the third embodiment is performed.

Since in the fourth embodiment, a force to be applied to the grinding stone 9 at the start of cutting can be reduced by bringing the grinding stone 9 into contact with the optical glass material 11 by the linear cutting R in the first stage, peripheral chipping of the material 11 (cracking of glass like a shell) can be substantially avoided. Moreover, although a spherical surface is generated by rotating the grinding stone 9 and thereby performing arcuate cutting θ of the optical glass material 11, arcuate cutting θ can also be performed so that the material 11 has the same spherical surface, by rotating the optical glass material 11 in a direction opposite to the θ-direction in which the grinding stone 9 is rotated, after performing the linear cutting R and then fixing the grinding stone 9 in position.

Accordingly, the fourth embodiment can provide a product (for example, a glass lens) with excellent outward appearance and quality.

Although as in the third embodiment, a fine polishing trace of a regular pattern was observed on the surface of the product resulting from the fourth embodiment, its optical properties were sufficient for various purposes. Further, since in the first stage, T-axial bending of the grinding stone 9 due to the radial force can be suppressed, a product of a high shape accuracy can be obtained. The other advantages of the fourth embodiment are similar to those of the third one.

Figure 11:
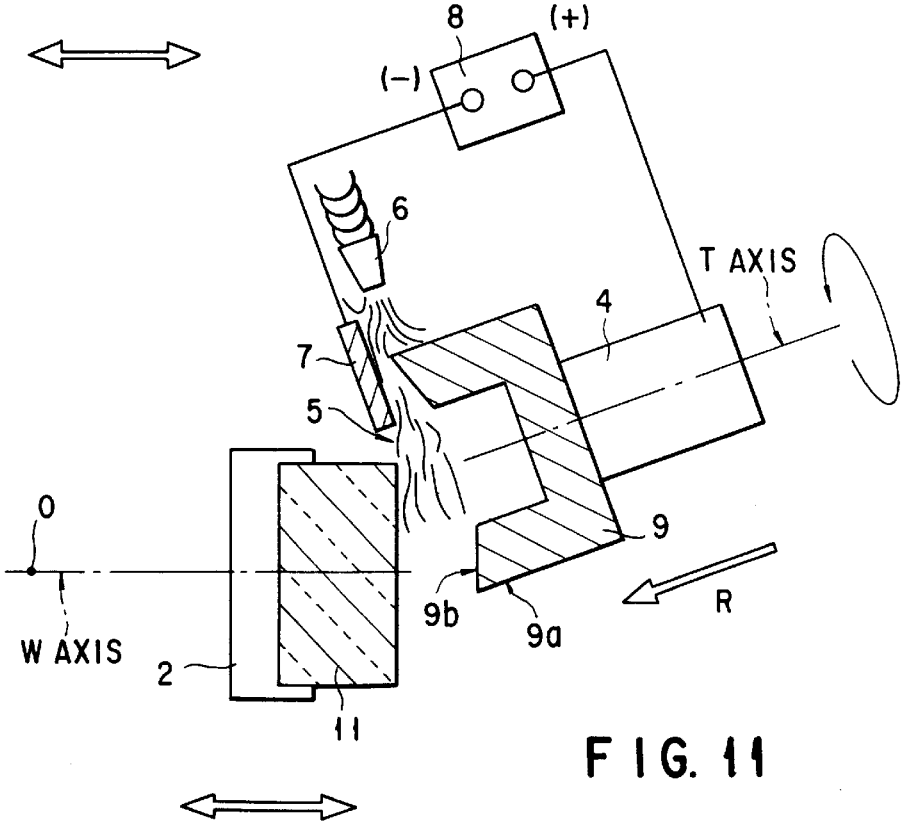
Figure 12:
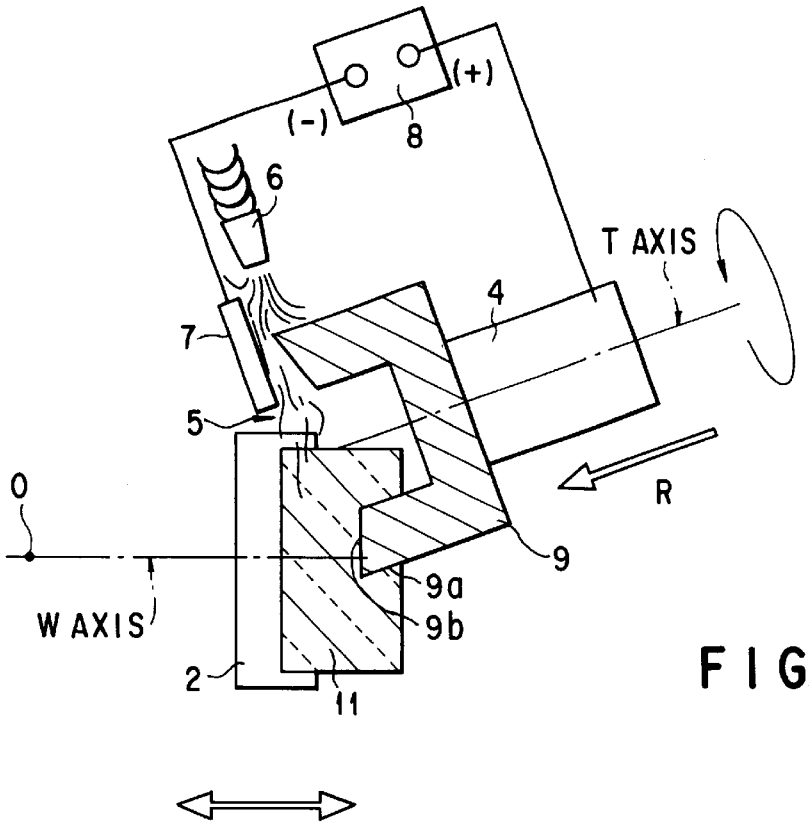
Figure 13:
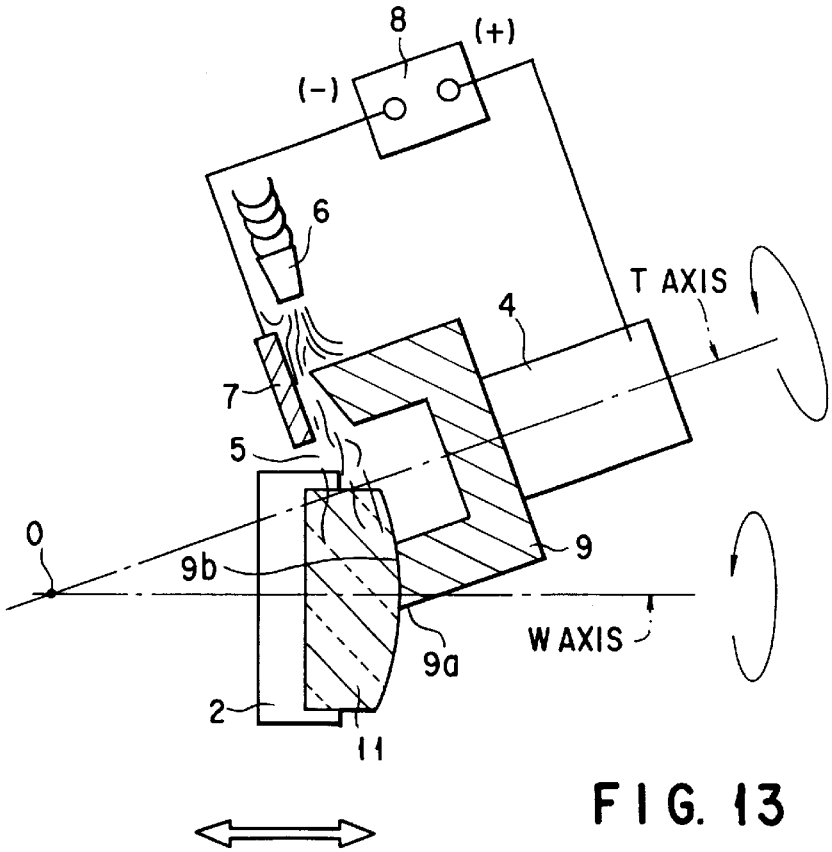

Referring then to FIGS. 11 to 13, a grinding method according to a fifth embodiment will be described.

A grinding device employed in the fifth embodiment is similar to those used in the third and fourth embodiments, except that it is equipped with an angle setting mechanism (not shown) for adjusting only the angle of the T axis with respect to the W axis.

The grinding device may have the same structure as the known curve generator. The grinding method according to the fifth embodiment includes two stages. In the first stage, the optical glass material 11 is not rotated, and the grinding stone 9, whose inclination is set at a certain value, is rotated and at the same time linearly moved to cut the stationary material 11. In the second stage, the surface of the optical glass material 11 is ground while it is rotated, using the rotating and inclined grinding stone 9.

Specifically, the grinding is performed as follows:

First, the inclination angle of the T axis to the W axis is obtained. The inclination angle is obtained by a method similar to the method employed in the known curve generator for determining the swivel angle. It is determined from the shape of the grinding stone 9 and the shape of a to-be-generated spherical surface, and more particularly is determined so that the spherical shape can be generated simply by rotating the optical glass material 11 with the grinding stone 9 kept in contact with the material 11. After determination of the inclination angle, the rotary shaft 4 of the grinding stone 9 is inclined by the angle setting mechanism and kept inclined.

Subsequently, the grinding stone 9 is rotated about the T axis of the rotary shaft 4, and at the same time, the polishing solution 5 which contains silica particles with negative charge is applied between the grinding stone 9 and the electrode 7 from the nozzle 6, and a negative voltage is applied from the DC power 8 to the electrode 7, and a positive voltage from the DC power 8 to the grinding stone 9 via the rotary shaft 4. The silica particles with negative charge are electrically attracted, as a result of the so-called electrophoresis, by the grinding stone 9 with the positive voltage, and electrically attached thereto.

Then, the grinding stone 9 is linearly moved along the T axis, and starts linear cutting R using the front face portion 9*b* as a shape generating face (first-stage cutting). During the linear cutting, a large force acts on the front face portion 9*b*, and hence most of silica fine particles attached thereto will fall. However, it suffices, in the first cutting stage, if grinding particles projecting from the front face portion 9*b* cut the optical glass material 11 in accordance with the conventional cutting method. Therefore, no problems will arise.

The linear cutting R is continued, and finished when the front face portion 9*b* has reached a line which is defined by the radius-of-curvature 12 of a to-be-generated spherical surface. Since at this time, the optical glass material 11 is not rotated, the grinding stone 9 sticks into the material 11.

Thereafter, while the supply of the polishing material 5 is continued, the optical glass material 11 is rotated about the W axis, thereby making the side face portion 9*a* cut into the material 11. Since the rotational speed of the material 11 also functions as the cutting speed of the grinding stone 9, it set lower than that employed in the third embodiment.

With the rotation of the optical glass material 11, the side face portion 9*a* of the grinding stone 9 stucks to the material advances in it. When the optical glass material 11 is rotated one full turn, cutting of the material into a spherical shape is completed as shown in FIG. 13. Then, the resultant flat convex lens is taken from the chuck 2. When the optical glass material 11 has been cut into the spherical shape, the front face portion 9*b* of the grinding stone 9 intersects the W axis. Since no linear cutting R is performed by the grinding stone 9 when the side face portion 9*a* removes the unnecessary portion of the optical glass material 11 by rotating the material about the W axis, almost no grinding force is exerted on the front face portion 9*b*. Accordingly, as in the third embodiment, the silica fine particles attached to the front face portion 9*b* of the grinding stone 9 polish the to-be-processed surface. In other words, the front face portion 9*b* functions as a polishing face.

The fifth embodiment can perform cutting, like the conventional curve generator, without the driving unit for revolving the grinding stone 9 employed in the third and fourth embodiments. In addition, although in the fifth embodiment, the grinding stone 9 is linearly moved along the T axis, thereby performing linear cutting R using the front face portion 9*b* of the stone, the linear cutting R by the front face portion 9*b* and hence the same cutting as above can be performed by linearly moving the optical glass material 11 along the W axis after setting the angle of the grinding stone 9 to the W axis and appropriately positioning the stone.

Although the grinding method of the fifth embodiment differs from the third embodiment, a polishing trace with a fine regular pattern as observed in the case of the third embodiment was observed on the surface of a glass lens produced by the grinding method of the fifth embodiment. This is because polishing is performed using fine particles. The optical properties of the resultant lens were sufficient for various purposes. In other words, the grinding method for simultaneously performing generation of a spherical surface and polishing the surface can be executed using the conventional curve generator (grinding device). The other advantages of the fifth embodiment are similar to those of the third embodiment.

Although in the fifth embodiment, a flat convex lens is produced, a flat concave lens can be produced if the edge shape of the grinding stone, or the positional relationship between the T axis and the W axis is changed from those shown in FIG. 11 so that a concave shape can be ground. Furthermore, if the resultant flat convex or concave lens is held on the chuck 2 with its reverse surface directed upward, and then a process as above is performed, a lens with opposite convex sides or concave sides can be produced. Although in the fifth embodiment, fine particles are attached to the grinding stone 9 before the linear cutting R is performed, they may be attached to the stone 9 when a final surface shape is generated after the optical glass material 11 is rotated about the W axis, and the side face portion 9*a* as a shape generating face is advanced into the material 11.

A sixth embodiment will be described with reference to FIG. 14.

Figure 14:
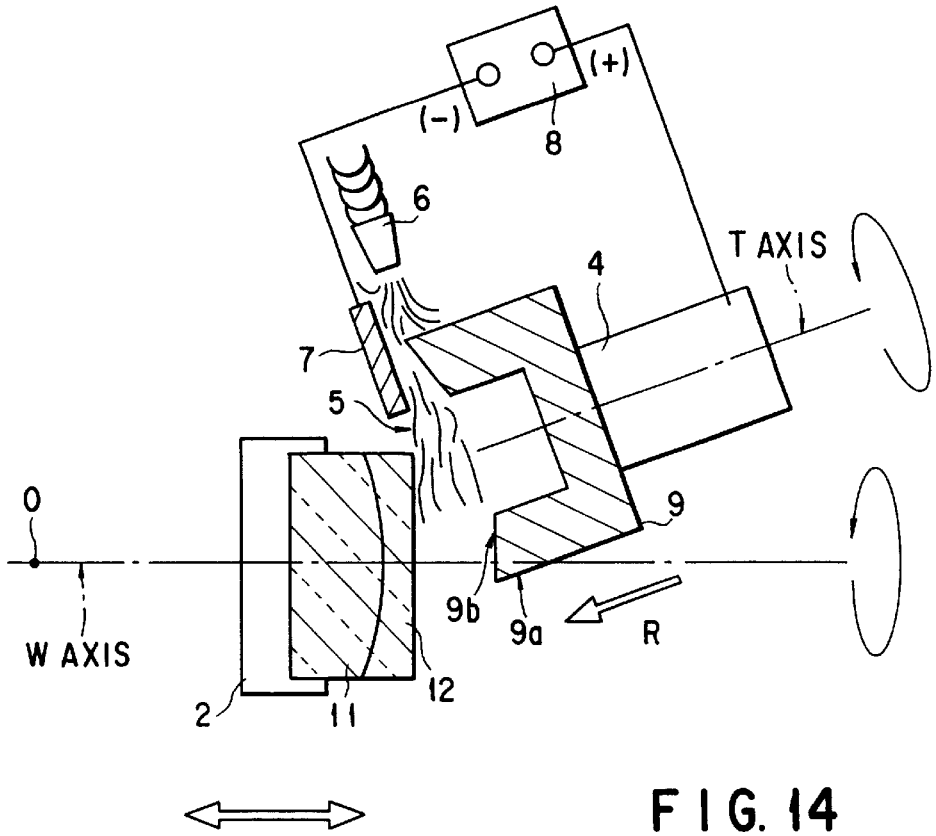
FIG. 14 is a view, useful in explaining a grinding method according to a sixth embodiment of the invention.

FIG. 14 is a schematic view, showing a curve generator used in the sixth embodiment.

The curve generator has the same structure as that used in the fifth embodiment, and hence no explanation is given thereof.

A grinding method using the curve generator will be described referring to FIG. 14. The process performed until the inclination angle of the T axis to the W axis is obtained is similar to that of the fifth embodiment.

While the grinding stone 9 and the optical glass material 11 are rotated about the T axis and the W axis, respectively, the polishing material 5 is supplied therebetween from the nozzle 6. At this stage, no voltage is applied between the electrode 7 and the grinding stone 9 from the DC power 8.

Subsequently, the grinding stone 9 is moved along the T axis, thereby starting linear cutting R using the front face portion 9*b* as a shape generating face, as in the conventional curve generating process.

When the linear cutting R is continued and then the front face portion 9*b* has reached a line which is defined by the radius-of-curvature 12 of a to-be-generated spherical surface, the linear cutting R is finished.

Then, while the linear cutting R is stopped and the positional relationship between the grinding stone 9 and the optical glass material 11 is kept, i.e. while the spark-out state is maintained, a negative voltage is applied from the DC power 8 to the electrode 7, and a positive voltage from the DC power 8 to the grinding stone 9 via the rotary shaft 4. Silica particles with negative charge, which are contained in the polishing solution 5 fed from the nozzle 6, are electrically attracted, as a result of the so-called electrophoresis, by the grinding stone 9 with the positive voltage, and electrically attached thereto. Since at this time, the grinding device is in the spark-out state, almost no grinding force acts on the front face portion 9*b*. Accordingly, most of the electrically attached silica fine particles do not fall from the grinding stone 9 and are used to polish the generated spherical surface into a mirror state. In other words, in the spark-out state, the front face portion 9*b* functions as a polishing face. As described above, the spherical surface is generated and then polished, which is the termination of working of the flat convex lens.

Although in the sixth embodiment, the grinding stone 9 is linearly moved along the T axis, thereby performing linear cutting R using the front face portion 9*b* of the stone, the linear cutting R by the front face portion 9*b* and hence the same cutting as above can be performed by linearly moving the optical glass material 11 along the W axis after setting the angle of the grinding stone 9 to the W axis and appropriately positioning the stone.

Since polishing was performed using silica fine particles, the flat convex lens resulting from the sixth embodiment had sufficient optical properties, although a fine polishing trace of a regular pattern was observed on the surface of the lens, as in the third embodiment. The other functions of the sixth embodiment were similar to those of the third one.

According to the sixth embodiment, generation of a spherical surface and polishing of the surface can be simultaneously performed using the conventional curve generator. The other advantages of the sixth embodiment were similar to those of the third one.

Although in the sixth embodiment, the cutting performed by the grinding stone 9 is linear cutting R, any other cutting manner may be employed since mirror surface grinding is performed in the spark-out state after the spherical surface is generated. Moreover, although this embodiment uses, throughout the cutting process, the polishing material 5 which contains silica fine particles with negative charge, a coolant used in the conventional grinding, for example, may be used until the device is sparked out. Further, although voltage application to the electrode 7 is performed in the spark-out state in the embodiment, it may be done throughout the cutting process.

Although in the sixth embodiment, a flat convex lens is produced, a flat concave lens can be produced if the edge shape of the grinding stone, or the positional relationship between the T axis and the W axis is changed from those shown in FIG. 11 so that a concave shape can be ground. Furthermore, if the resultant flat convex or concave lens is held on the chuck 2 with its reverse surface directed upward, and then working as above is performed, a lens with opposite convex sides or concave sides can be produced.

Figure 15:
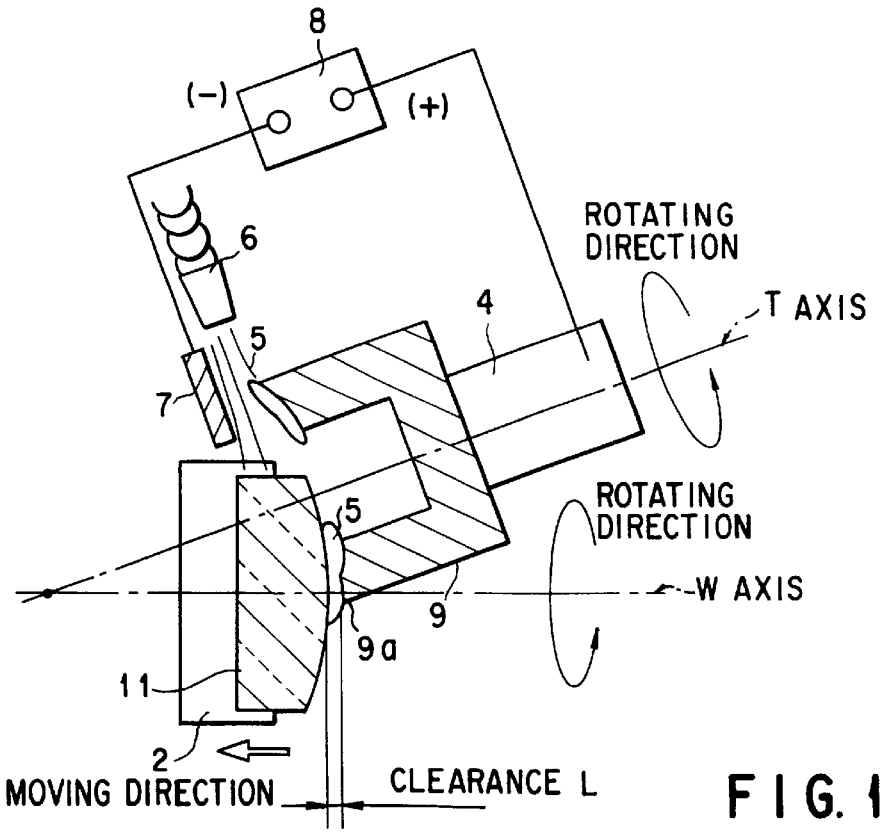
FIG. 15 is a view, useful in explaining the grinding method according to the seventh embodiment, together with FIGS. 6 to 8.

A seventh embodiment which is an application of the third and fourth embodiments will be described with reference to FIGS. 6 to 8 referred to for the description of the third embodiment, and also with reference to FIG. 15.

That part of the process of the seventh embodiment which corresponds to FIGS. 6 to 8 is similar to the third embodiment. Specifically, in the seventh embodiment, arcuate cutting θ is performed, as shown in FIG. 8, until the portion of the grinding stone 9 which contacts the optical glass material 11 reaches the W axis, with silica fine particles with negative charge electrically attached to the grinding stone 9 with positive voltage. After the arcuate cutting θ, one or both of the grinding stone 9 and the optical glass material 11 are moved to define a clearance L therebetween as shown in FIG. 15. At the time of defining the clearance L, it is more desirable to move the grinding stone 9 so that it can have a center-of-revolution substantially identical to the center O.

The clearance L is defined by moving the grinding stone 9 along the T axis away from the optical glass material 11, using the stone driving unit described in the third embodiment, or by moving the optical glass material 11 along the W axis away from the grinding stone 9, using the to-be-processed object driving unit described in the third embodiment, or by simultaneously moving both the grinding stone 9 and the optical glass material 11 away from each other as aforementioned.

The position of the grinding stone 9 in the direction of its revolution with respect to the optical glass material 11, which is assumed immediately after the clearance L is defined, is where the arcuate cutting θ is finished. At this time, the grinding stone 9 and the optical glass material 11 are rotated in their positions about the T axis and the W axis by the grinding stone driving unit and the to-be-processed object driving unit, respectively. Even after the clearance L is defined, silica fine particles are attached and built up as a result of the electrophoresis phenomenon. Thus, the clearance L is filled with the silica fine particles, and the resultant silica layer further polishes the generated spherical surface of the optical glass material 11.

After the polishing by the silica layer which blocks the clearance L is finished, the grinding stone 9 is shifted along the T axis away from the optical glass material 11 and returned to its initial position shown in FIG. 6, by its driving unit. At this time, the supply of the polishing material 5 from the nozzle 6, the voltage application by the power 8, and the rotation of the grinding stone 9 and the material 11 are stopped, and the resultant flat convex lens is taken from the chuck 2.

In the seventh embodiment, the grinding and polishing of a spherical lens is performed in the same process as in the third embodiment, and further polishing is performed only by silica fine particles built up in the clearance L. The latter polishing can eliminate a defect or flaw on the outward appearance of the resultant spherical lens. In other words, when a grinding stone of a shape as employed in the second embodiment is used to perform arcuate cutting θ of the optical glass material 11, there is always a non-contact portion between the grinding stone 9 and the material 11, and a similar advantage can be obtained from the non-contact portion. However, positive forming of the clearance L made in this embodiment will provide a more smooth mirror surface.

If attachment and growth of the polishing material 5 using the electrophoresis phenomenon is performed without the clearance L, the bonding material contained in the grinding stone will elute because of electrolysis in accordance with the growth of the polishing material 5 such as silica. Since the bonding material holds grinding particles such as diamond particles contained in the grinding stone, the diamond particles may well fall from the stone when the bonding material has eluted. If they fall from the stone, they rotate between the rotating grinding stone and the optical glass material when no clearance L is formed. As a result, flaws may well be formed on the glass material surface. On the other hand, where the clearance L is formed, fallen diamond particles are discharged without being kept between the grinding stone and the optical glass material, and only silica particles grown in the clearance L are put into contact with the material 11 and polish the material. As a result, no flaws will be formed on the surface. For example, when #600 diamond particles are contained in the grinding stone, the diamond average diameter is 26 to 31 $\mu$m. Therefore, occurrence of flaws due to fall of grinding particles can be avoided by setting the clearance L sufficiently larger than the average diameter.

It is evident that the clearance L should be set in light of the size (#) of grinding particles contained in a grinding stone employed and/or the kind of a bonding material used. When, in particular, a bonding material which will easily elute is used, the grinding particles may well fall. Therefore, a clearance with a width appropriate to the conditions should be defined.

The optical glass material 11 and the grinding stone 9 may be abruptly moved away from each other so as to set the clearance L at once, or be moved gradually. If in the latter case, the growth speed of a silica fine particle layer due to the electrophoresis phenomenon is set higher than the movement speed of the grinding stone and the optical glass material to gradually enlarge the clearance L, the polishing of the optical glass material 11 by the silica fine particles is continued without interruption, thereby enhancing the efficiency of the process.

When in the seventh embodiment, the grinding stone AD600-N100M manufactured by Asahi Diamond Industry Co., Ltd. was used, and electrophoresis was caused to occur with the voltage set at 40V and colloidal silica set at 6% by weight, growth at a speed of 0.2 mm/min. was observed. Therefore, if the clearance L is formed at a speed of 0.2 mm or less per minute under the above conditions, the growing layer of silica fine particles is kept in contact with the optical glass material, whereby efficient polishing of the material is performed without interruption.

A regular polishing trace similar to but finer than that obtained in the third embodiment was observed on a flat convex lens polished by silica fine particles.

As described above, the seventh embodiment can provide advantages similar to the third embodiment. Further, it enables more smooth mirror surface grinding of a to-be-polished surface since only the layer of fine particles grown in the clearance is put into contact with the optical glass material to be polished. The clearance L further serves to prevent contact of grinding particles of the grinding stone with the optical glass material, and also to discharge therethrough fallen grinding particles, if any, without putting them into contact with the to-be-worked surface of the optical glass material, thereby to prevent forming of flaws on the to-be-worked surface.

According to an aspect of the invention, a desired shape can be generated from a material and more smooth mirror surface grinding can be performed than a grinding stone used therein can, without exchanging the grinding stone with another. Therefore, the time required from shape generation to surface polishing can significantly be reduced.

According to another aspect of the invention, shape generation using a shape generating face and polishing using a polishing face can be performed without exchanging a grinding stone used therein with another. Therefore, the time required from shape generation to surface polishing can significantly be reduced.

According to a further aspect of the invention, the above-described advantages can be obtained using the conventional curve generator.

According to yet another aspect of the invention, the number of fine particles attached to a polishing face is increased, thereby enabling more improved polishing.

According to another aspect of the invention, a layer of fine particles is grown in a clearance, which further improves mirror surface grinding of the to-be-polished surface. Moreover, the clearance can prevent grinding particles fallen from the grinding stone, if any, from damaging the to-be-polished surface.

According to still another aspect of the invention, the mirror surface grinding enables a lens with excellent optical properties to be made in a short time and at low cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A mirror surface grinding method for grinding an optical glass material into a desired shape, and polishing a surface of the optical glass material into a mirror surface using different faces of a grinding stone, the grinding stone being formed by attaching grinding particles thereto with a conductive bonding material, the method comprising the steps of:

applying a voltage to the grinding stone;

supplying the grinding stone with a polishing solution which contains charged fine particles, thereby electrically attaching the charged fine particles to the grinding stone;

bringing the grinding stone into contact with the optical glass material; and rotating and moving the grinding stone relative to the optical glass material along a final shape to be generated from the optical glass material, thereby grinding, including cutting, and removing an unnecessary portion of the optical glass material, using a side face portion of the grinding stone, and at the same time polishing the final shape surface of the optical glass material into a mirror surface using the charged fine particles attached to a front face portion of the rotating and moving grinding stone, the front face portion being different from the side face portion.

2. A method according to claim 1, wherein the grinding stone is cup-shaped such that the front face portion is an annular face portion.

3. A method according to claim 2, wherein the front face portion of the grinding stone is tapered from a side-face-portion side toward an axis of the grinding stone.

4. A method according to claim 1, wherein the front face portion of the grinding stone includes at least two concentric annular face portions of different levels.

5. A method according to claim 1, further comprising, after the step of polishing the final shape surface of the optical glass material using the fine particles attached to the front face portion of the grinding stone, defining a clearance between the polished final shape surface and the front face portion of the grinding stone by separating the grinding stone from the final shape surface, and further polishing the final shape surface using fine particles attached to the front face portion.

6. A glass lens ground and polished by the mirror surface grinding method described in claim 1, the glass lens having a polishing trace formed on its surface by fine particles attached to the grinding stone as a result of the electrophoresis phenomenon, the polishing trace having a regular pattern caused by relative movement of the grinding stone and the glass material and having a depth of 10 nm or less.

7. A mirror surface grinding method for grinding an optical glass material into a desired shape, and polishing a surface of the optical glass material into a mirror surface using different faces of a grinding stone, the grinding stone being formed by attaching grinding particles thereto with a conductive bonding material, the method comprising the steps of:

preparing a grinding stone which has a shape generating face for cutting the optical glass material to thereby grind the optical glass material, and a polishing face for polishing a surface generated by the shape generating face, the polishing face being different from the shape generating face;

applying a voltage to the grinding stone;

holding the optical glass material with holding means;

supplying a polishing solution, which contains charged fine particles, between the grinding stone and the optical glass material; and moving at least one of the grinding stone and the optical glass material relative to each other such that the grinding stone and optical glass material contact one another, cutting the optical glass material by the shape generating face of the grinding stone to thereby grind the optical glass material into a desired shape surface, and at the same time polishing the desired shape surface by the fine particles attached to the polishing face of the grinding stone, while electrically attaching fine particles to the grinding stone on a continuous basis.

8. A method according to claim 7, wherein the grinding stone is cup-shaped.

9. A method according to claim 7, further comprising, after the step of polishing the desired shape surface, separating the grinding stone from the optical glass material, and continuing polishing using fine particles attached to the polishing face of the grinding stone.

10. A glass lens obtained by rotating a grinding stone and an optical glass material, moving the grinding stone and optical glass material relative to each other such that the grinding stone and optical glass material contact one another, thereby grinding the optical glass material into a desired shape and polishing a surface of the optical glass material into a mirror surface by grinding particles electrically attached to a surface which is different from said surface, the glass lens having a trace of a regular pattern caused by the relative movement of the grinding stone and the glass material.

11. A glass lens according to claim 10, wherein the regular pattern consists of a group of striped polishing traces.

* * * * *